US006716059B1

(12) United States Patent
Cussans et al.

(10) Patent No.: US 6,716,059 B1
(45) Date of Patent: Apr. 6, 2004

(54) PANEL MOUNTED ELECTRICAL CONNECTOR

(75) Inventors: Mark K. Cussans, Kalamazoo, MI (US); Michael R. Kamarauskas, Bloomingdale, IL (US); Yan Margulis, Buffalo Grove, IL (US); Scott M. Mueller, Carpentersville, IL (US); Robert Wirkus, Aurora, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/424,379

(22) Filed: Apr. 28, 2003

(51) Int. Cl.[7] ..... H01R 13/73
(52) U.S. Cl. ..... 439/557; 439/135; 439/247
(58) Field of Search ..... 439/135, 247, 439/248, 544, 546, 547, 557

(56) References Cited

U.S. PATENT DOCUMENTS 3,523,267 A 8/1970 Pauza
3,912,355 A 10/1975 Curado et al.
4,029,953 A 6/1977 Natoli
4,934,951 A 6/1990 Schonath
5,401,174 A * 3/1995 Hansen ..... 439/34
5,407,363 A 4/1995 Polgar et al.
5,478,256 A 12/1995 Koganemaru et al.
5,772,469 A * 6/1998 Polgar et al. ..... 439/546
5,888,093 A 3/1999 Polgar et al.

* cited by examiner

*Primary Examiner*—Tho D. Ta
*Assistant Examiner*—James R. Harvey
(74) *Attorney, Agent, or Firm*—Stephen Z. Weiss

(57) ABSTRACT

An electrical connector is provided for mounting in an opening in a panel which has an elongated channel having overhanging lips along opposite sides thereof defining a narrowed mouth running longitudinally of the channel. The opening communicates through the channel. A connector housing is insertable into the opening and into the channel in an insertion direction. The housing is rotatable within the opening. At least one locking projection extends outwardly of the housing generally perpendicular to the insertion direction. The locking projection is sized for passing through the narrowed mouth defined by the overhanging lips of the channel and for locking engagement behind one of the lips in response to rotation of the housing within the opening. A latch projection is disposed on the outside of the housing and is latchingly engageable in the narrowed mouth of the channel automatically in response to the rotation of the housing within the opening.

21 Claims, 7 Drawing Sheets

PANEL MOUNTED ELECTRICAL CONNECTOR

FIELD OF THE INVENTION

This invention generally relates to the art of electrical connectors and, particularly, to an electrical connector for mounting in an opening in a panel.

BACKGROUND OF THE INVENTION

A wide variety of electrical connectors have been designed for mounting in various types of panels, such as mounting in an opening in a panel. "Slot wall" panels are used for mounting a wide variety of items for display purposes. Such panels have slots or grooves in a front face thereof to hold brackets, support shelving, hangers or signs. Channels are formed in a rear face of the panel for mounting the panel to a support structure or for facilitating the mounting of free-standing supports.

In some instances, panels of the character described above are used to mount items, such as signs, which require electricity to operate components of the items or to simply illuminate the signs. Consequently, electricity must be fed to those items, preferably from the rear of the panel in order to hide the electrical wiring. Consequently, the electricity is fed through holes or openings in the panel from the rear side thereof to the items supported on the front side of the panel. The present invention is directed to improvements in electrical connectors for mounting in openings in panels, such as the slot wall panels described above.

SUMMARY OF THE INVENTION

An object, therefore, of the invention is to provide a new and improved electrical connector for mounting in an opening in a panel.

Another object of the invention is to provide a panel mounted electrical connector system for a panel which has an elongated channel, with the opening communicating through the channel.

As disclosed herein, the channel is elongated and has overhanging lips along opposite sides thereof. The lips define a narrowed mouth running longitudinally of the channel.

In the exemplary embodiment of the invention, the connector includes a housing insertable into the opening and into the channel in an insertion direction. The housing is rotatable within the opening. At least one locking projection extends outwardly of the housing generally perpendicular to the insertion direction. The locking projection is sized for passing through the narrowed mouth defined by the overhanging lips of the channel and for locking engagement behind one of the lips in response to rotation of the housing within the opening. A latch projection is provided on the outside of the housing and is latchingly engageable in the narrowed mouth of the channel automatically in response to the rotation of the housing within the opening.

According to one aspect of the invention, the housing is generally cylindrical for rotation within a generally cylindrical opening in the panel. A pair of the locking projections are provided on diametrical opposite sides of the housing for locking engagement behind the overhanging lips on opposite sides of the channel.

According to another aspect of the invention, the latch projection is located on a flexible arm attached to the housing. The housing is molded of plastic material, with the flexible arm being integral therewith.

According to a further aspect of the invention, the housing is inserted into the opening in the panel from one side thereof and includes a receptacle exposed at an opposite side thereof for receiving a complementary mating connecting device. A protective cap is insertable into the receptacle exposed at the opposite side of the panel.

According to the system of the invention, the channel in the panel has a generally dovetail configuration in cross-section to define angled interior walls. As the connector housing is inserted into the opening in the panel, the locking projections pass through the narrowed mouth of the panel and, when the housing is rotated, the locking projections ride along the angled interior walls of the channel to cam the housing axially in the insertion direction in response to rotation of the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
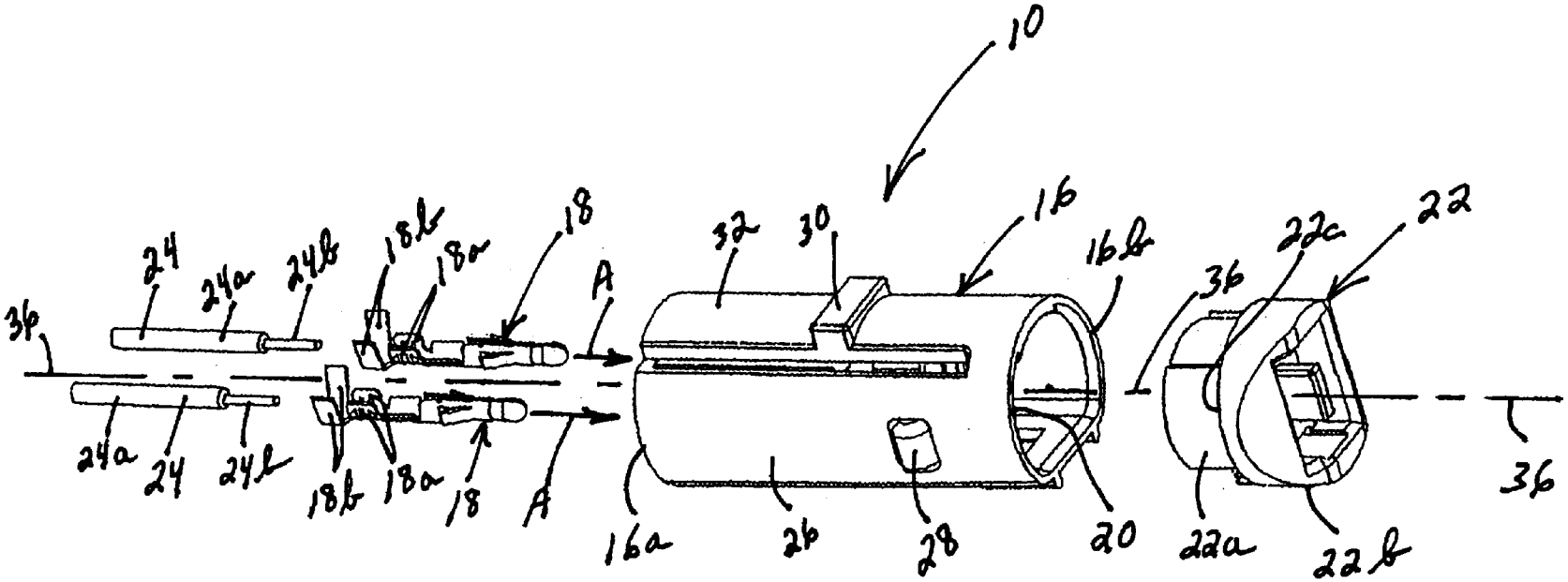
FIG. 1 is an exploded perspective view of an electrical connector embodying the concepts of the invention.
Figure 3:
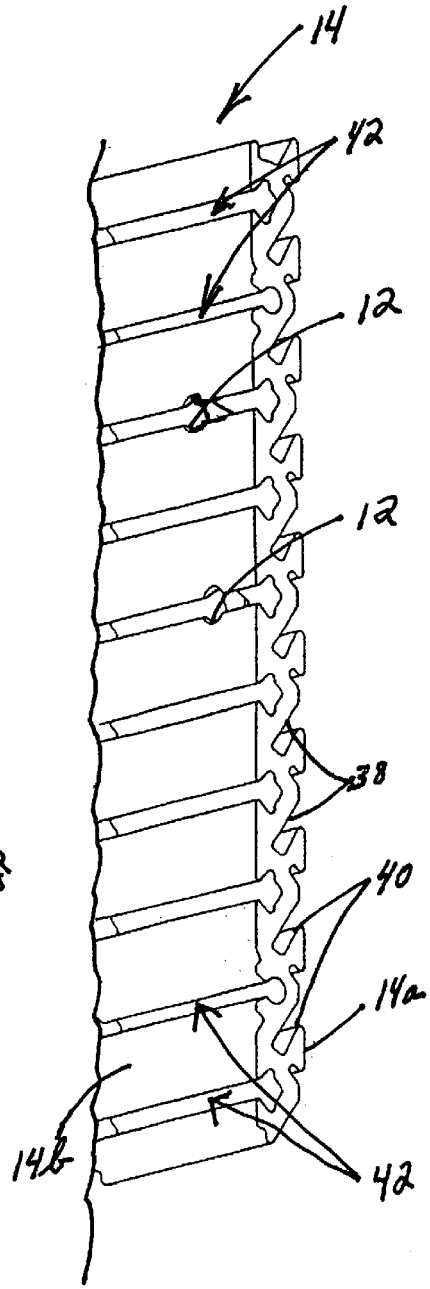
FIG. 3 is a fragmented perspective view of one end of a slot wall panel according to the invention.

Referring to the drawings in greater detail, and first to FIG. 1, the invention is embodied in an electrical connector, generally designated 10, for mounting in an opening 12 in a panel, generally designated 14 in FIG. 3. The connector includes a housing, generally designated 16, for mounting a plurality (two) of conductive terminals, generally designated 18. The terminals are inserted into a rear terminating end 16*a* of the housing in the direction of arrows "A". A front mating end 16*b* of the housing is open to define a receptacle 20 for receiving a complementary mating connector as described hereinafter.

Each terminal 18 of connector 10 is designed for terminating an electrical wire 24 having an outer insulation 24*a* stripped back to expose an inner conductor 24*b*. Each terminal 18 includes a pair of arms 18*a* for clamping onto the conductor of a respective one of the electrical wires.

Each terminal also includes a pair of arms 18*b* for clamping on the outer insulation of the respective electrical wire for strain relief purposes. The terminals are stamped and formed of conductive sheet metal material. However, it should be understood that the configuration of terminals 18 can be changed or modified in a variety of ways for terminating discrete electrical wires.

Figure 2:
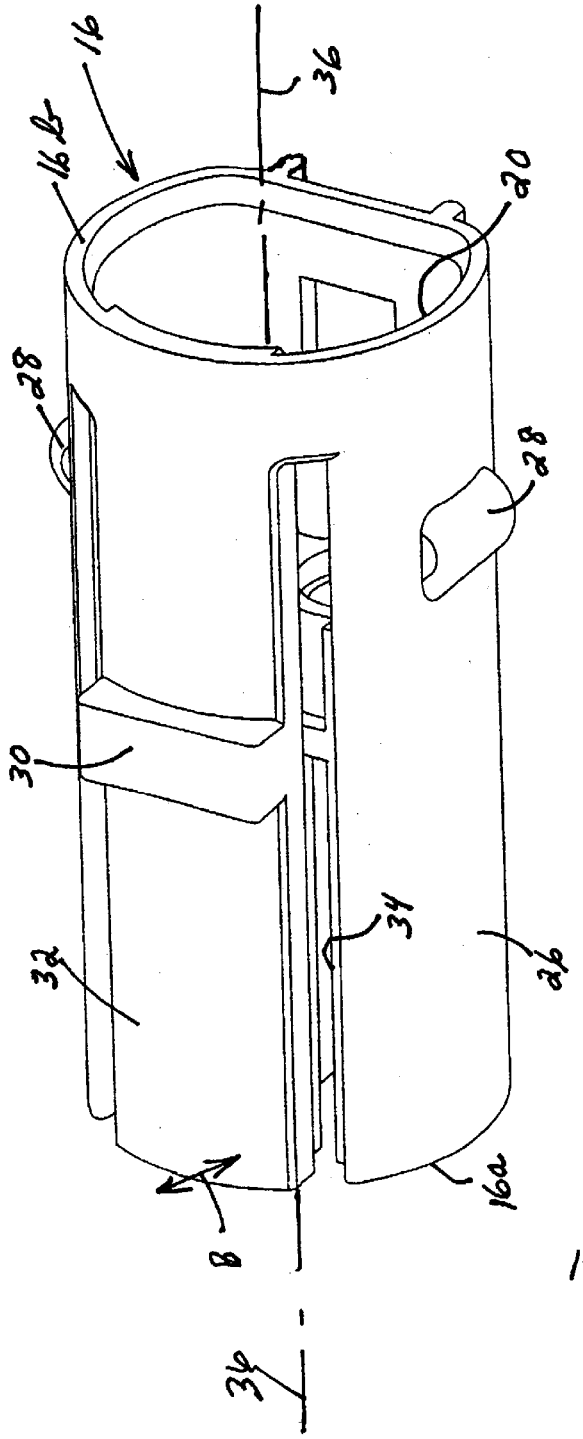
FIG. 2 is an enlarged perspective view of the connector housing.

Referring to FIG. 2 in conjunction with FIG. 1, housing 16 of connector 10 is a one-piece structure unitarily molded of dielectric material, such as plastic or the like. The housing includes an outer wall 26 which is generally cylindrical. A pair of integral locking projections 28 extend outwardly from diametrical opposite sides of the housing. A latch projection 30 is integral with the housing and extends outwardly therefrom at a location generally equidistant from and between locking projections 28. In other words, latching projection 30 is angularly spaced 90° from and between the locking projections. The latching projection is located on the outside of a flexible arm 32 which is formed out of an elongated opening 34 running axially of the cylindrical housing. Therefore, flexible arm 32 and latching projection 30 can flex radially in the direction of double-headed arrow "B" (FIG. 2). The cylindrical housing is elongated as seen in FIGS. 1 and 2 and defines a central axis 36 of the connector.

End cap 22 includes a stub shaft portion 22*a* for insertion into receptacle 20 of housing 16. The end cap includes an enlarged head portion 22*b* defining a circular shoulder 22*c* which abuts against mating end 16*b* of the housing when stub shaft portion 22*a* is inserted into receptacle 20.

FIG. 3 shows a section of "slot wall" panel 14 to illustrate that the panel includes a front side or face 14*a* and a rear side or face 14*b*. A plurality of generally parallel, display-mounting grooves 38 are formed in the front side of the panel. The grooves define hooks 40 from which various items, such as brackets, support shelving, hangers, signs or the like can be hung for display purposes. Rear side 14*b* of the panel includes a plurality of generally parallel channels, generally designated 42, which are used for various purposes, such as mounting the panel on a support structure or for mounting free standing support members thereto. As stated above, one or more openings 12 are formed in the panel and into which mating end 16*b* of connector housing 16 is inserted. In a normal orientation, grooves 40 in the front side of the panel and channels 42 in the rear side of the panel will run generally horizontal when the, panel is erect or vertical.

Figure 4:
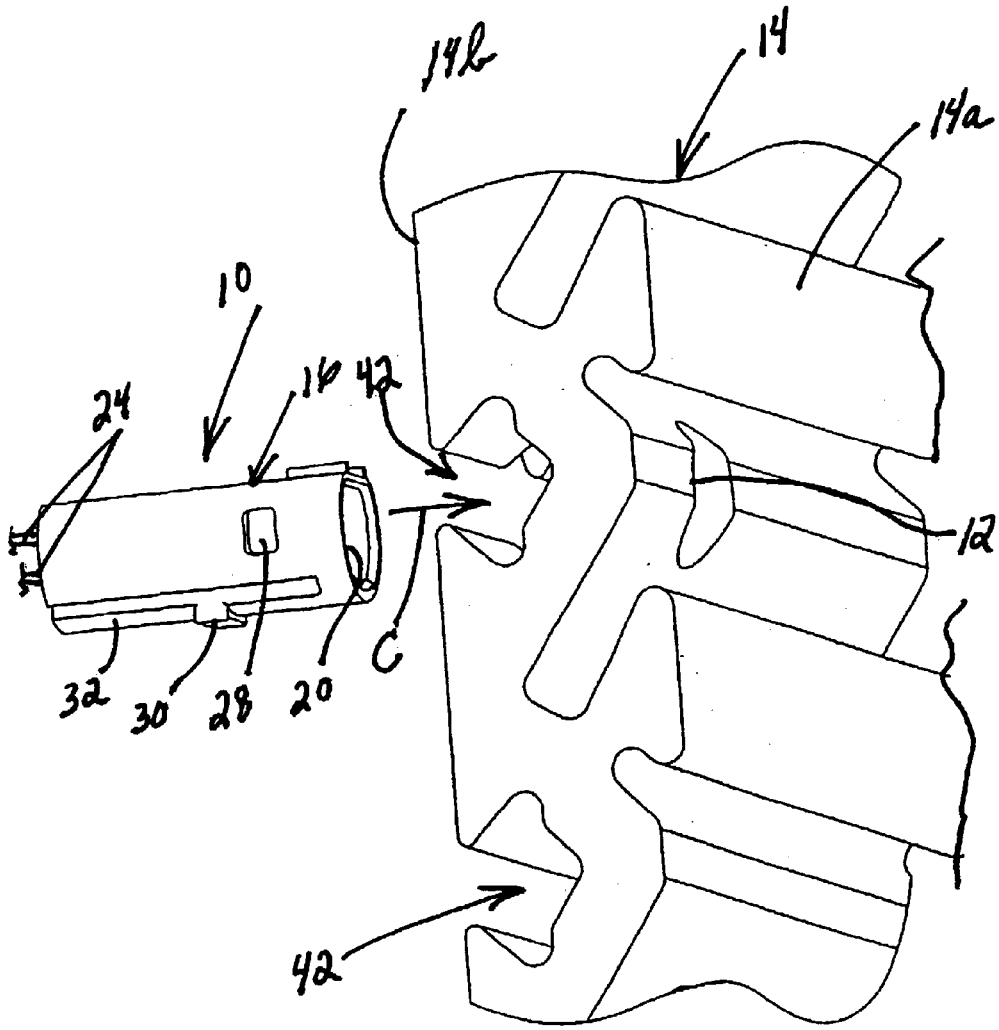
FIG. 4 is a perspective view of the connector about to be inserted into one of the channels at the rear side of the panel.

With that understanding, FIG. 4 shows a connector 10 according to the invention, including cylindrical housing 16, about to be inserted into one of the openings 12 communicating through one of the channels 42 in panel 14 in an insertion direction, as indicated by arrow "C". For the ease of disclosure, the end cap 22, discussed below and shown in FIGS. 1 and 8, has been removed from FIGS. 4–7. The terminals of the connector are terminated to electrical wires 24 so that the wires protrude rearwardly beyond rear side or face 14*b* of the panel. When the connector housing is fully inserted and locked in the panel, receptacle 20 will be aligned with opening 12 at the front side 14*a* of the panel as described hereinafter.

Figure 5:
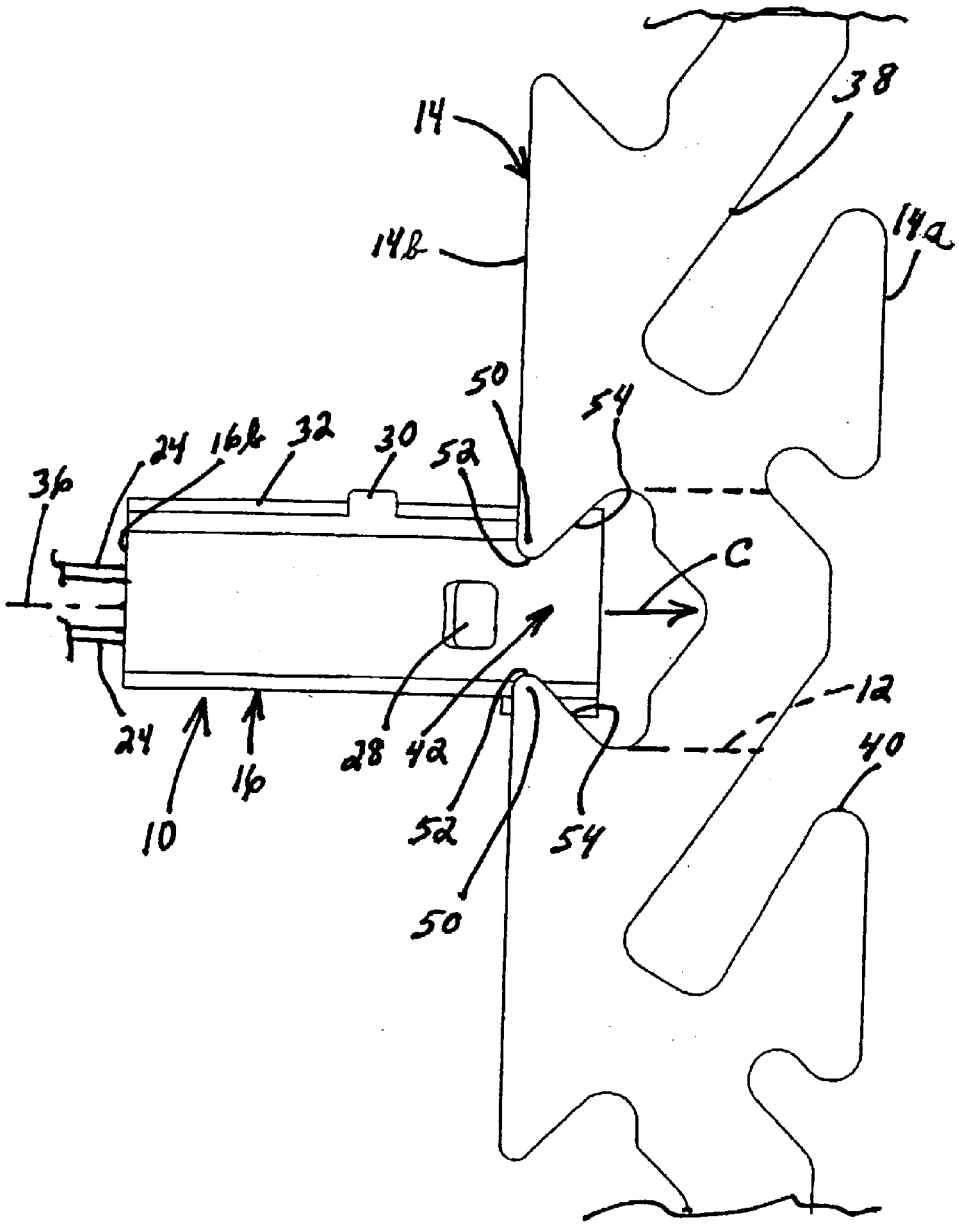
FIGS. 5–7 are sequential views showing the insertion and rotation of the connector to its fully locked position in the panel.
Figure 6:
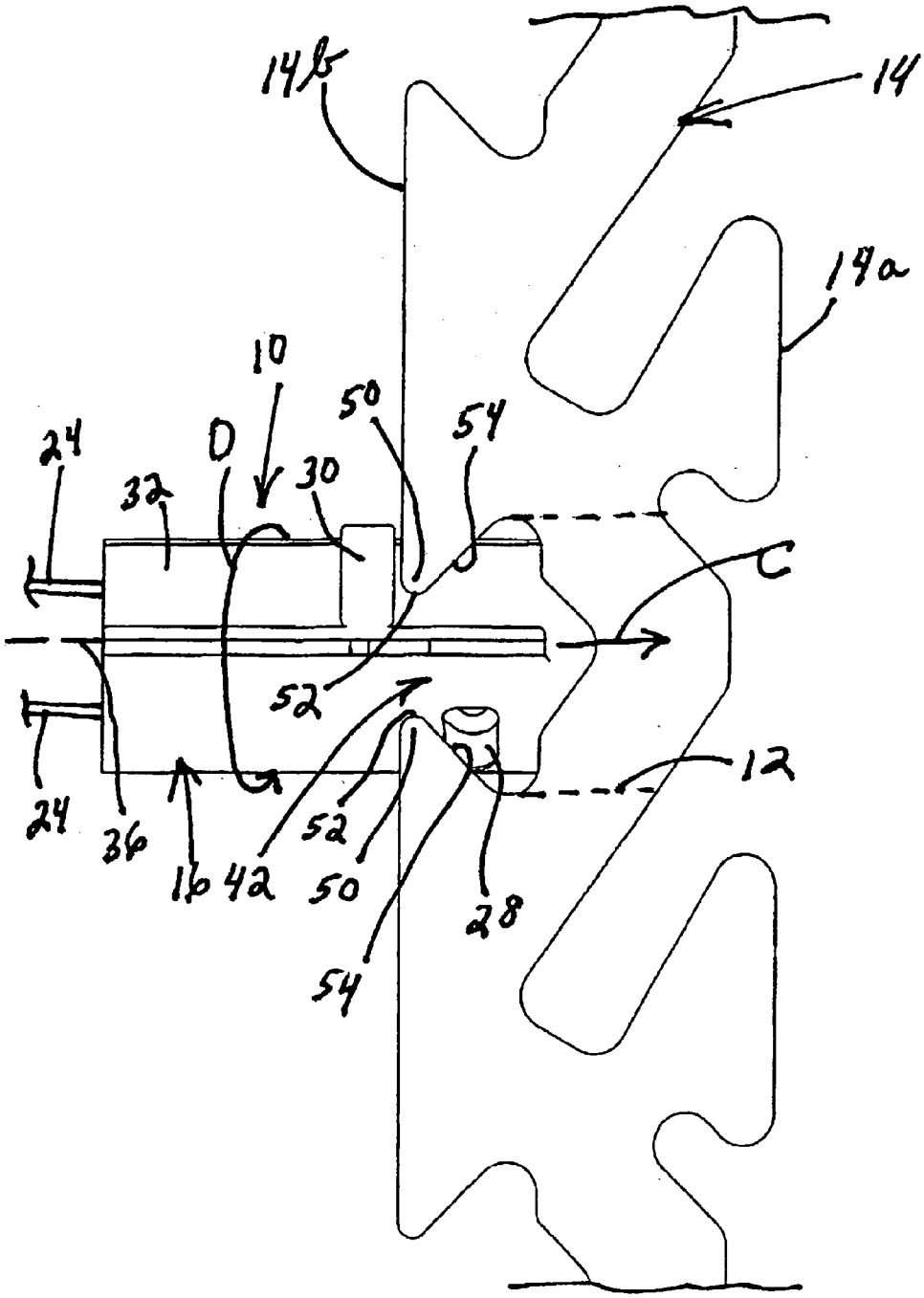
Figure 7:
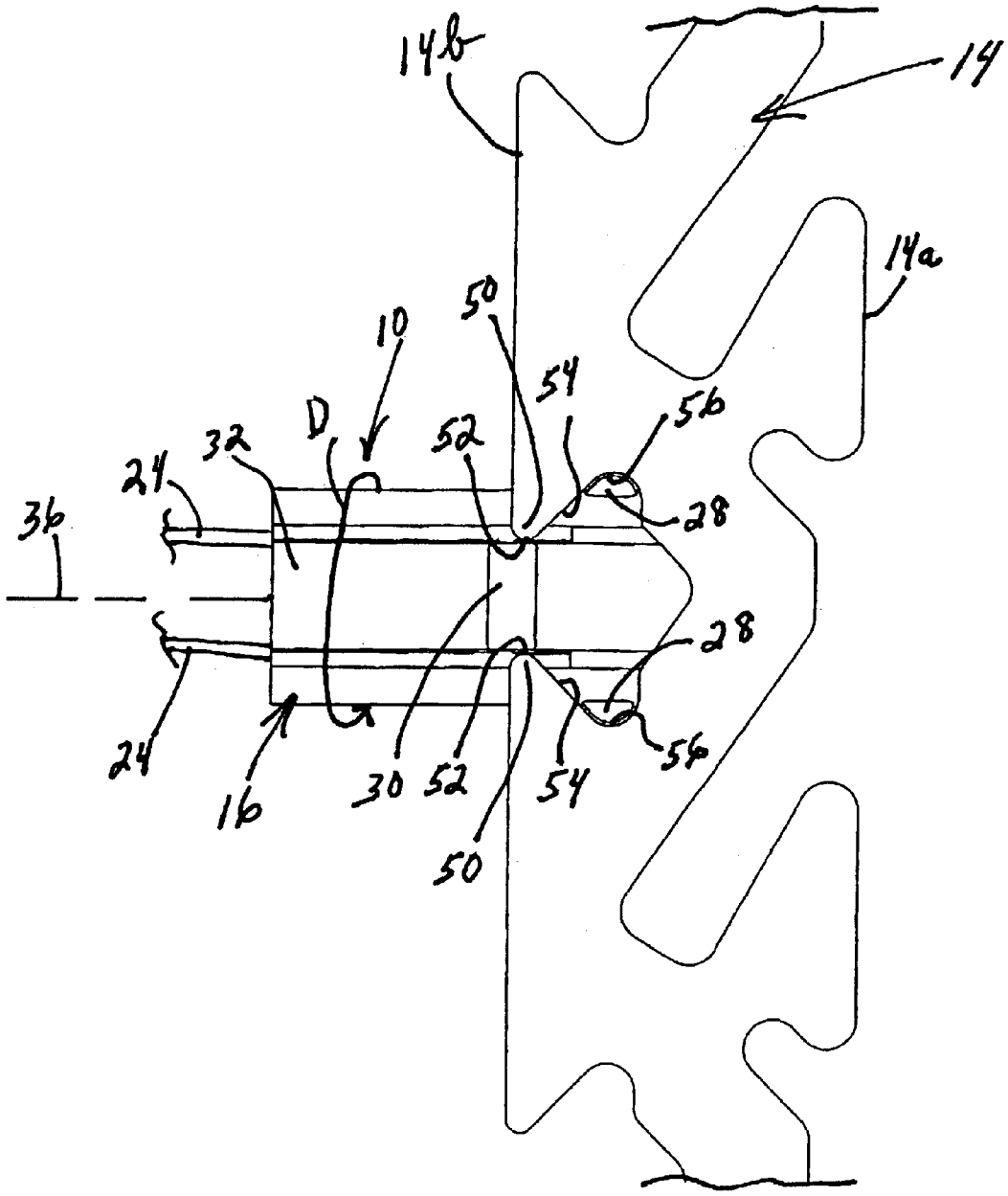

FIGS. 5–7 are sequential views showing the insertion of housing 16 of connector 10 into one of the channels in rear side 14*b* of the panel in the direction of arrow "C" and into one of the aligned openings 12 in the panel. The channel is elongated and has a pair of overhanging lips 50 extending along opposite sides of the channel to define a narrowed mouth 52 running longitudinally of the channel. Opening 12 in the panel is aligned with the respective channel and with narrowed mouth 52. The channel has a generally dovetail configuration 54 in cross-section to define angled interior walls 54.

With the above understanding of the configuration of channel 42, FIG. 5 shows housing 16 of connector 10 initially being inserted into the channel and into one of the openings 12 (also see FIG. 3) which is aligned with the channel. The housing is angularly oriented so that the diametrically opposite pair of locking projections 28 are aligned with mouth 52 of the panel so that the locking projections can pass through the mouth when the housing is inserted in the direction of arrow "C". It can be seen that latching projection 30 is not aligned with the mouth.

FIG. 6 shows housing 16 of connector 10 being rotated about its central axis 36 in the direction of arrow "D". During this rotation, locking projections 28 engage angled interior walls 54 of the channel to cam the housing further in the insertion direction of arrow "C". In this process, latching projection 30 rotates toward elongated mouth 52 of the channel.

FIG. 7 shows housing 16 of connector 10 rotated further in the direction of arrow "D" until locking projections 28 seat or "lock" into a pair of base grooves 56 formed at the extreme opposite sides of the elongated dovetail shaped channel. The connector is now located at its fully inserted position and cannot be pulled or backed-out of the opening opposite the direction of arrow "C". In order to latch the connector in its fully inserted position, latching projection 30 resiliently "snaps" into latching engagement within narrowed mouth 52 of the channel. This occurs automatically due to the flexibility of arm 32 from which the latching projection extends.

In regard to the dimensions of locking projections 28 and latching projection 32, locking projections 28 must be sufficiently narrow to pass through mouth 52 as can be understood by looking at FIG. 5. Latching projection 30 must be sufficiently narrow to engage within mouth 52 as shown in FIG. 7, but the latching projection 30 preferably is wide enough to avoid unnecessary rotational slack of the housing within the channel. When it is desirable to remove connector 10 from within opening 12 and channel 42 of the panel, latch 32 is depressed to disengage latching projection 30 out of mouth 52. At the same time, housing 16 is rotated to unseat or unlock the locking projections 28 from angled interior walls 54 of base grooves 56. When locking projections 28 are aligned with mouth 52, the connector simply is pulled backward out of the panel, opposite insertion direction "C".

Figure 8:
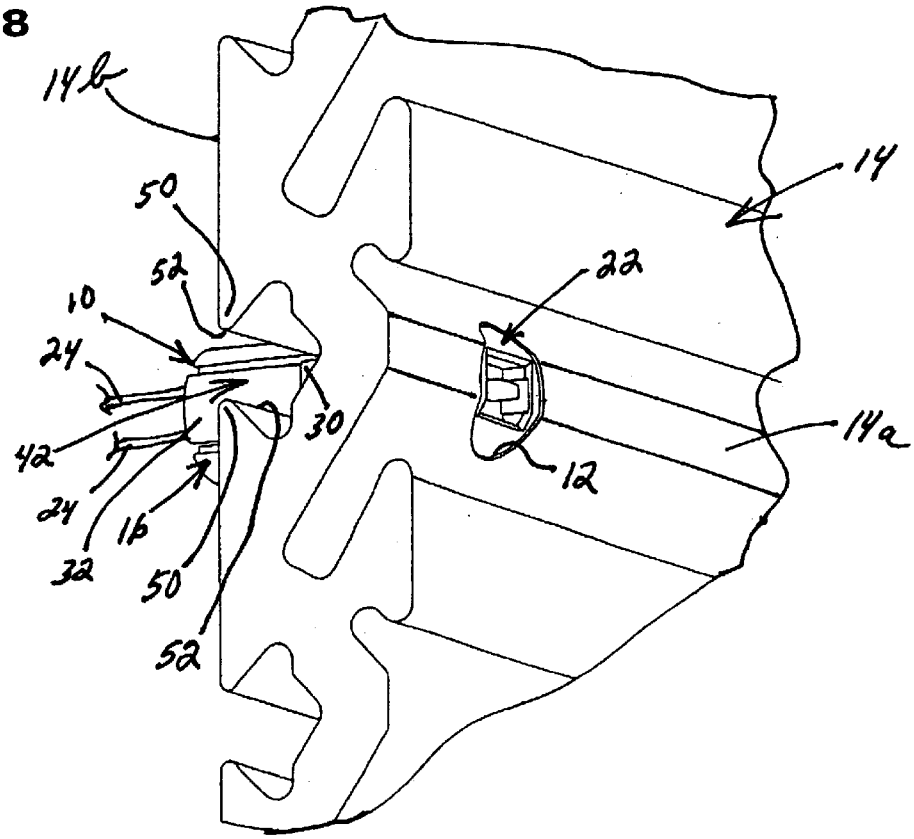
FIG. 8 is a perspective view showing the front side of the panel, with the protective cap inserted into the connector.

FIG. 8 simply shows front side 14*a* of panel 14, with connector 10 fully inserted into the panel. The end cap 22, which is held in the connector housing 16 to protect the interior components of the connector, is removed through opening 12 in the panel by gripping and pulling tab 22. Preferably, the outer face of the end cap is contoured to be flush with or below the front contour of the panel to allow for the engagement of brackets to the panel with no interference with the cap 22.

Figure 9:
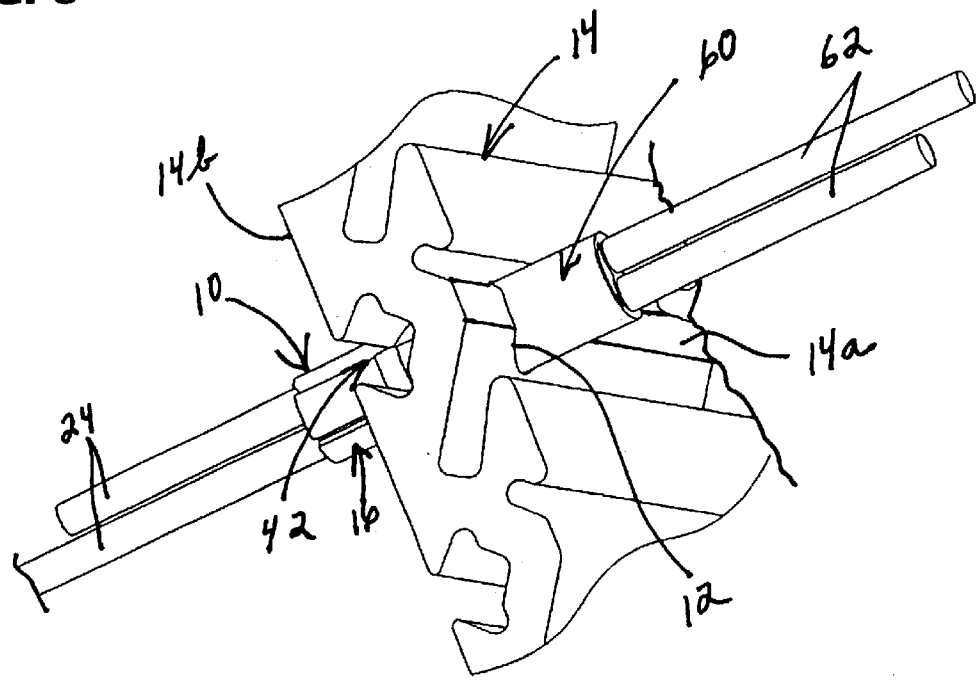
FIG. 9 is a perspective view with the protective cap removed and showing a complementary mating connector mated with the connector of the invention at the front side of the panel.

Finally, FIG. 9 shows connector 10 fully inserted into opening 12 in panel 14, and with a complementary mating connector, generally designated 60, inserted into the opening from front side 14*a* of the panel. The mating connector is inserted into receptacle 20 (not visible in the drawing) at the front mating end of connector housing 16. Mating connector 60 includes terminals (not shown) terminated to a pair of electrical wires 62, with the terminals of mating connector 20 being mateable with terminals 18 of connector 10.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for mounting in an opening in a panel which has an elongated channel having overhanging lips along opposite sides thereof defining a narrowed mouth running longitudinally of the channel, the opening communicating through the channel, comprising:

a connector housing insertable into the opening and into the channel in an insertion direction, the housing being rotatable within the opening;

at least one locking projection extending outwardly of the housing generally perpendicular to the insertion direction, the locking projection being sized for passing through the narrowed mouth defined by the overhanging lips of the channel and for locking engagement behind one of the lips in response to rotation of the housing within the opening; and a latch projection on the outside of the housing and latchingly engageable in the narrowed mouth of the channel automatically in response to said rotation of the housing within the opening.

2. The electrical connector of claim 1, including a pair of said locking projections on diametrical opposite sides of the housing for locking engagement behind the overhanging lips on opposite sides of the channel.

3. The electrical connector of claim 1 wherein said housing is generally cylindrical for rotation within a generally cylindrical opening in the panel.

4. The electrical connector of claim 1 wherein said latch projection is located on a flexible arm attached to the housing.

5. The electrical connector of claim 4 wherein said housing is molded of plastic material with said flexible arm being integral therewith.

6. The electrical connector of claim 1 wherein said housing is inserted into the opening in the panel from one side thereof and includes a receptacle exposed at an opposite side thereof for receiving a complementary mating connecting device.

7. In combination with the electrical connector of claim 6, a protective cap removably insertable into the receptacle exposed at the opposite side of the panel.

8. An electrical connector for mounting in a generally cylindrical opening in a panel which has an elongated channel having overhanging lips along opposite sides thereof defining a narrowed mouth running longitudinally of the channel, the opening communicating through the channel, comprising:

a generally cylindrical connector housing insertable into the opening and into the channel in an insertion direction, the housing being rotatable within the opening;

a pair of locking projections extending outwardly of the housing generally perpendicular to the insertion direction at diametrical opposite sides of the housing, the locking projections being sized for passing through the narrowed mouth defined by the overhanging lips of the channel and for locking engagement behind the lips in response to rotation of the housing within the opening; and a latch projection on the outside of the housing and latchingly engageable in the narrowed mouth of the channel automatically in response to said rotation of the housing within the opening, the latch projection being located on a flexible arm attached to the housing.

9. The electrical connector of claim 8 wherein said housing is molded of plastic material with said flexible arm being integral therewith.

10. The electrical connector of claim 8 wherein said housing is inserted into the opening in the panel from one side thereof and includes a receptacle exposed at an opposite side thereof for receiving a complementary mating connecting device.

11. In combination with the electrical connector of claim 10, including a protective cap removably insertable into the receptacle exposed at the opposite side of the panel.

12. A panel mounted electrical connector system for mounting an electrical connector in an opening in a panel, comprising:

a panel including an elongated channel having overhanging lips along opposite sides thereof defining a narrowed mouth running longitudinally of the channel, the opening in the panel communicating through the channel;

a connector housing insertable into the opening and into the channel in an insertion direction, the housing being rotatable within the opening;

at least one locking projection extending outwardly of the housing generally perpendicular to the insertion direction, the locking projection being sized for passing through the narrowed mouth defined by the overhanging lips of the channel and for locking engagement behind one of the lips in response to rotation of the housing within the opening; and a latch projection on the outside of the housing and latchingly engageable in the narrowed mouth of the channel automatically in response to said rotation of the housing within the opening.

13. The panel mounted electrical connector system of claim 12, including a pair of said locking projections on diametrical opposite sides of the housing for locking engagement behind the overhanging lips on opposite sides of the channel.

14. The panel mounted electrical connector system of claim 12 wherein said housing is generally cylindrical for rotation within a generally cylindrical opening in the panel.

15. The panel mounted electrical connector system of claim 12 wherein said latch projection is located on a flexible arm attached to the housing.

16. The panel mounted electrical connector system of claim 15 wherein said housing is molded of plastic material with said flexible arm being integral therewith.

17. The panel mounted electrical connector system of claim 12 wherein said housing is inserted into the opening in the panel from one side thereof and includes a receptacle exposed at an opposite side thereof for receiving a complementary mating connecting device.

18. In combination with the system of claim 17, including a protective cap removably insertable into the receptacle exposed at the opposite side of the panel.

19. The panel mounted electrical connector system of claim 12 wherein said panel includes a plurality of said channels in a rear side thereof.

20. The panel mounted electrical connector system of claim 19 wherein said panel includes a plurality of display-mounting grooves in a front side thereof.

21. The panel mounted electrical connector system of claim 12 wherein said channel has a generally dovetail configuration in cross-section to define angled interior walls along which said locking projection rides to cam the housing axially in said insertion direction in response to rotation of the housing.

* * * * *